United States Patent [19]

Nakada

[11] 4,414,928

[45] Nov. 15, 1983

[54] PORT SCAVENGING TYPE TWO-CYCLE INTERNAL COMBUSTION ENGINE

[75] Inventor: Hiroyasu Nakada, Hamamatsu, Japan

[73] Assignees: Yamaha Hatsudoki Kabushiki Kaisha, Itawa; Sanshin Kogyo Kabushiki Kaisha, Hamamatsu, both of Japan

[21] Appl. No.: 336,718

[22] Filed: Jan. 4, 1982

[30] Foreign Application Priority Data

Jan. 22, 1981 [JP] Japan ..... 56-8880

[51] Int. Cl.[3] ..... F02B 33/04

[52] U.S. Cl. ..... 123/73 PP; 123/73 R

[58] Field of Search ..... 123/73 PP, 73 R, 73 A, 123/73 B

[56] References Cited

U.S. PATENT DOCUMENTS 4,287,860 9/1981 Fujikawa et al. ..... 123/73 PP

FOREIGN PATENT DOCUMENTS 809265 7/1951 Fed. Rep. of Germany ... 123/73 PP 2319662 11/1974 Fed. Rep. of Germany ... 123/73 PP 441668 1/1936 United Kingdom ..... 123/73 PP

*Primary Examiner*—Wendell E. Burns

*Attorney, Agent, or Firm*—Ernest A. Beutler

[57] ABSTRACT

A porting and scavenging system for a two-cycle internal combustion engine that permits a more compact arrangement. The engine employs scavenging passages that lie on opposite sides of a plane passing through the cylinder axis and the center of the exhaust ports. These scavenging passages are arcuate in cross-sections perpendicular to the cylinder axis and their centers lie on the plane but are offset from the cylinder axis to the side opposite the exhaust ports. In addition, the scavenge passages extend at an angle to the cylinder axis so that their outlets into the cylinders disposed further from the exhaust ports than their inlets from the crankcase. This arrangement not only improves compactness but significantly improves scavenging.

13 Claims, 6 Drawing Figures

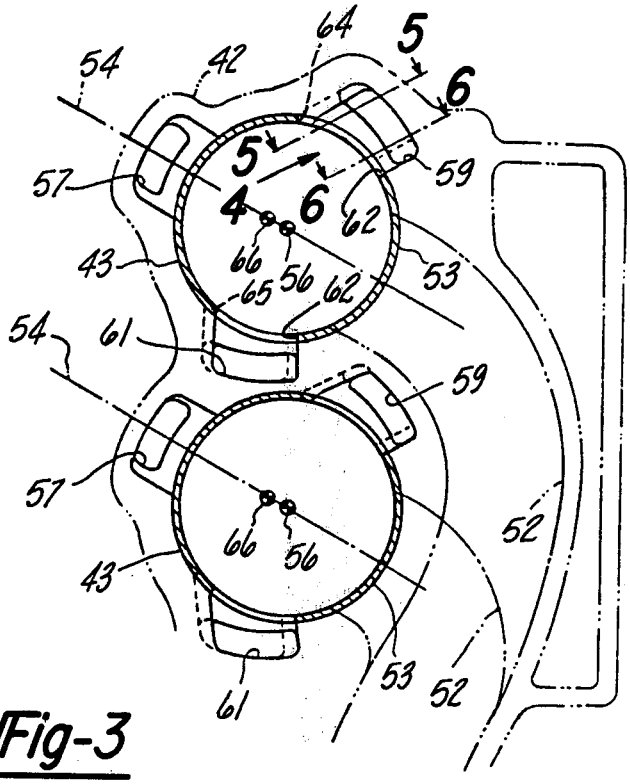
Fig-3
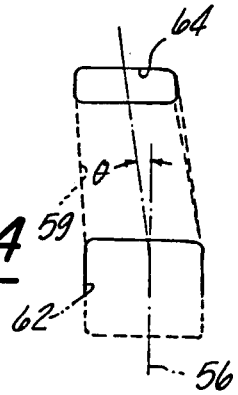
Fig-4
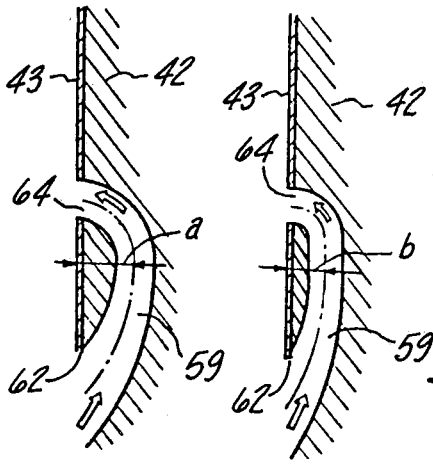
Fig-6
Fig-5

PORT SCAVENGING TYPE TWO-CYCLE INTERNAL COMBUSTION ENGINE

BACKGROUND OF THE INVENTION

This invention relates to an improved porting arrangement for a scavenged type two-cycle internal combustion engine and more particularly to a porting arrangement that permits a more compact engine configuration.

In port scavenged two-cycle internal combustion engines it has been the practice to provide pairs of scavenging passages arranged symmetrically with repect to a plane that passes through the center axis of the corresponding cylinder. In order to permit a compact arrangement it has been the practice to dispose this plane at an angle other than at a right angle to the crankshaft axis. Although such a disposition does permit a more compact arrangement than if the ports and related passages were at right angles, the arrangement still does not permit the maximum degree of compactness. In addition, even with only a single cylinder this porting arrangement requires a relatively large cylinder casting and engine assembly.

It is, therefore, a principle object of this invention to provide an improved porting arrangement for a two-cycle engine.

It is a further object of this invention to provide an improved scavenging system for an internal combustion engine of the two-cycle type that permits a more compact assembly while at the same time improving scavenging.

SUMMARY OF THE INVENTION

A first feature of this invention is adapted to be embodied in a porting system for a two-cycle engine having a cylinder, exhaust port means openings through a wall of said cylinder and being intersected by a plane passing through the axis of said cylinder, and a plurality of scavenging passages having scavenging ports in said cylinder on opposite sides of said plane. In accordance with this feature of the invention, the centers of the scavenging passages lie in a plane that is perpendicular to the first mentioned plane and which is offset from the cylinder axis on the side opposite to the exhaust port means.

Another feature of the invention is also adapted to be embodied in an engine having exhaust port means and scavenge passages having scavenge ports on opposite sides of a plane as described in the preceding paragraph. In accordance with this feature of the invention, the scavenge passages lie closer to the cylinder wall on the side adjacent the exhaust port means than they do on the side remote from the exhaust port means.

Yet another feature of this invention is also adapted to be embodied in a porting system for a two-cycle engine as described in the two preceding paragraphs. In accordance with this feature of the invention, the scavenge passages have inlet openings in the crankcase and the scavenge ports are disposed at an offset relationship to the inlet openings and on the side away from the exhaust port means.

BRIEF DESCRIPTION OF THE DRAWINGS

FIG. 3 is a cross-sectional view taken along the line 3—3 of FIG. 2 and is similar, in part, to FIG. 1 in that both views are taken along substantially the same plane.

FIG. 4 is a view taken in the direction of the arrow 4 in FIG. 3.

FIG. 5 is a cross-sectional view taken along the line 5—5 of FIG. 3.

FIG. 6 is a cross-sectional view taken along the line 6—6 of FIG. 3.

DESCRIPTION OF THE PRIOR ART

Figure 1:
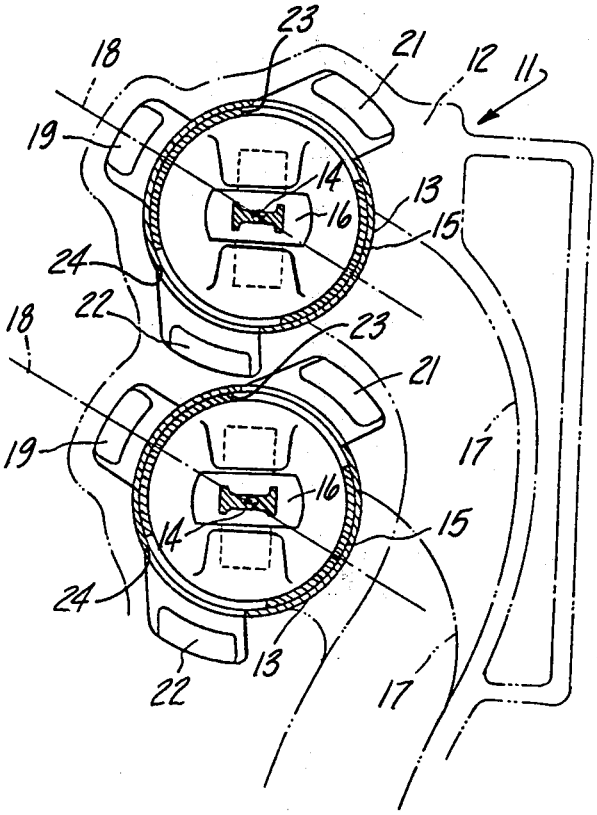
Fig-1 PRIOR ART
FIG. 1 is a cross-sectional view of a two-cycle internal combustion engine constructed in accordance with the prior art and is taken from the crankshaft side of the pistons and perpendicular to the cylinder bore axes.
Figure 2:
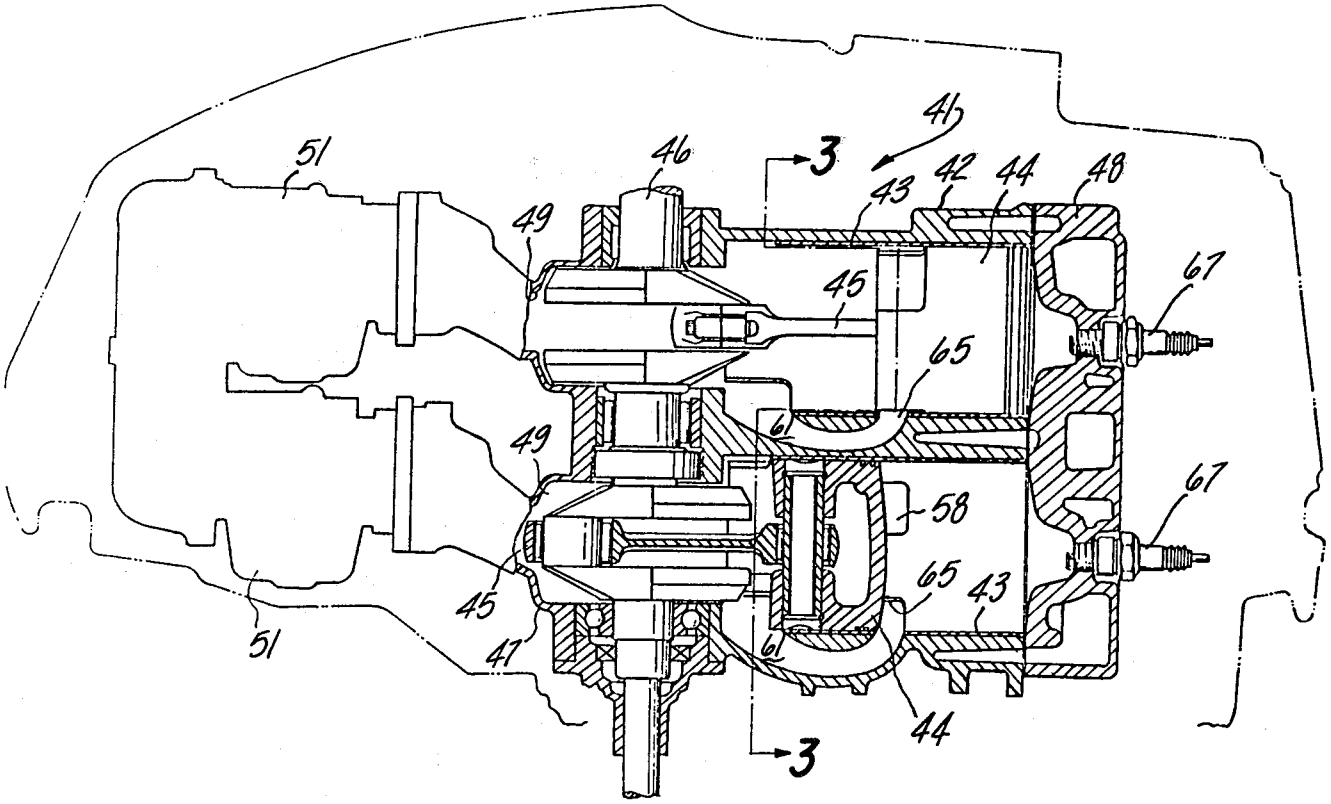
FIG. 2 is a side elevational view, with portions shown in section and other portions broken away, of a two-cycle engine constructed in accordance with this invention.

A two-cycle, two cylinder in line internal combustion engine having a porting system constructed in accordance with the prior art is shown in FIG. 1 and is identified generally by the reference numeral 11. In order to emphasize the construction of the porting arrangement, certain components of the engine 11 have been shown in phantom.

The engine 11 includes a cylinder block 12 having pairs of cylinder liners 13 that have axes 14 that are parallel to each other. Pistons 15 are supported for reciprocation in the cylinder liners 13 and are connected by means of connecting rods 16 to a crankshaft in a known manner.

Exhaust ports (not shown) extend through the cylinder liners 13 and deliver exhaust gases to respective exhaust passages 17. The centers of the exhaust ports lie on a plane that contains the axis 14 of the respective cylinder liner 13, this plane being identified at 18.

Auxiliary scavenging passages 19 extend from the crankcase of the engine through the cylinder block 12 and terminate in auxiliary scavenging ports (not shown) formed in the cylinder liners 13. These ports have their centers lying on the planes 18 and diametrically opposed to the exhaust ports.

Scavenging passages 21 and 22 are provided in the cylinder block 12 extending from the crankcase and terminating in respective scavenge ports 23 and 24 formed in the cylinder liner 13. The scavenge passages 21 and 22 are symmetrically disposed relative to the plane 18 and have their centers lying on a plane that extends perpendicular to the plane 18 through the respective cylinder axis 14. The passages 21 also have an arcuate cross section in planer perpendicular to the cylinder axis 14. The center of this arcuate configuration is coincident with axis 14.

It should be noted that the planes 18 are rotated relative to the axis of the crankshaft of the engine so that they are disposed in nonperpendicular relationship to it. This arrangement as may be readily seen from FIG. 1 causes the scavenge passage 22 associated with the uppermost cylinder liner 13 to be offset from the scavenge passage 21 of the adjacent cylinder liner 13. This permits a more compact arrangement than would be possible if the planes 18 were at right angles to the crankshaft axis. Even though this arrangement permits some compaction of the engine, the porting arrangement as described results in a relatively longer engine than necessary. Furthermore, even if only a single cylinder engine is employed it should be relatively apparent from FIG. 1 that the cylinder block must be relatively wide so as to accommodate the passages 21 and 22.

DETAILED DESCRIPTION OF THE PREFERRED EMBODIMENT

A two-cycle two cylinder outboard motor constructed in accordance with this invention is shown in FIGS. 2 through 6 and is identified generally by the reference numeral 41. Although the invention is described in conjunction with an engine of this type it is to be understood that it may be employed in conjunction with single cylinder engines, engines having other cylinder configurations and other than outboard motors.

The engine 41 includes a cylinder block 42 in which parallel cylinder liners 43 are positioned. Pistons 44 are reciprocally supported in the cylinder liners 43 and are connected by means of connecting rods 45 to a crankshaft 46 that is supported for rotation about a vertically extending axis. The crankshaft 46 is supported by the cylinder block 42 and by a crankcase 47 in a known manner. A cylinder head 48 is affixed to the cylinder block 42 and encloses the upper ends of the cylinder liners 43.

As is well known with two-cycle crankcase compression engines, the crankcase cavities 49 associated with each of the cylinder liners 43 is supplied with a fuel air charge, as by means of carburetors 51. The carburetors 51 discharge into the crankcase cavities 49 through reed type check valves (not shown).

Exhaust passages 52 (FIG. 3) extend from exhaust ports 53 formed in the cylinder liners 43 through the cylinder block 42 for discharging the exhaust gases. As with the prior art type of constructions, the exhaust ports 53 each have their centers lying on a plane 54 that contains the axis of the respective cylinder liner 43, which axis is identified by the point 56. The planes 54 are disposed in nonperpendicular relationship to the axis of rotation of the crankshaft 46 and a line passing through the cylinder liner axes 56.

Auxiliary scavenge passages 57 are formed in the cylinder block 42 and extend from the crankcase cavities 49 to scavenge ports 58 (only one of which appears in FIG. 2) which are disposed with their centers also on the plane 54.

In accordance with this invention, scavenge passages 59 and 61 are formed in the cylinder block 42 for each of the cylinders. The scavenge passages 59 and 61 are disposed upon opposite sides of the plane 54. The arrangement of the scavenge passages 59 and 61 is such that it is possible to place the centers of the cylinder liners 43 closer to each other to result in a more compact arrangement. Alternatively, when the invention is applied to a single cylinder type of engine it permits a more compact arrangement than with previously proposed porting arrangements.

The scavenge passages 59 and 61 each have a respective inlet opening 62 into the crankcase which is disposed with its center slightly offset from the cylinder axis 56 on the side opposite the exhaust port 53. This relationship is best shown in FIG. 4 wherein the scavenge passage inlet is identified by the numeral 62. The scavenge passages 59 and 61 are also disposed so that they extend through the cylinder block 42 in such an orientation that the portion of each passage closer to the exhaust port 53 lies at a closer distance to the cylinder liner 43 than the portion which is furthest from the exhaust port 53. This is achieved by virtue of the fact that the passages 53 and 61 are arcuate in shape in cross sections taken perpendicular to the cylinder axes 56. Unlike the prior art, however, this arcuate shape is not generated about the cylinder axis 56. In accordance with this invention, the arcuate shape is generated about an axis 66 that is offset from the cylinder axis 56 on the side opposite the exhaust ports 53. This arrangement may be best seen in FIGS. 3, 5, and 6. FIG. 6 is a cross-sectional view taken through a plane closer to the exhaust port 53. As may be readily seen from this figure, the center of the scavenge passage 59 is displaced from the cylinder liner 43 by a distance identified by the dimension "b". On the other hand, at a section taken a greater distance from the exhaust port 53 (FIG. 5), the center of the scavenge passage 59 is at a greater distance from the cylinder liner 43, this distance being identified by the dimension "a".

The scavenge passages 59 and 61 terminate in scavenge ports 64 and 65, respectively, which are formed in the cylinder liners 53. The scavenge ports 64 and 65 are symmetrical to each other about the plane 54, however, the centers of the ports 64 and 65 are offset relative to the axis 56 on the side opposite the exhaust port 54. The center of symmetry or the line through which the centers of the scavenge ports 64 and 65 pass is also identified by axis 66. This offset is also emphasized in FIG. 4 wherein the angle of offset relative to the axis 56 is identified by the angle $\theta$.

The engine 41 undergoes cycles of operation as with normal two-cycle engines. That is, as the crankshaft 46 rotates, the pistons 44 will reciprocate in the cylinder liners 43. When the pistons 44 are traveling upward in the cylinder liners 43 the charge which has been transferred above them, in the manner to be described, will become compressed and fired by spark plugs 67. At the same time, a fresh fuel air charge will be delivered from the carburetors 51 into the respective crankshaft chambers 49. When the pistons 44 are driven downwardly by the expanding gases, the charge in the crankcase chambers 49 will be compressed. Eventually, the pistons 44 will move downwardly so as to open the exhaust ports 53 and permit the combustion products to be discharged to the atmosphere through the exhaust passages 52. Upon further downward movement, the ports 64 and 65 will be open and the compressed charge from the crankcase will be transferred to the combustion chambers via the scavenge passages 59 and 61. Upon further downward movement, the auxiliary scavenge passage 57 will be opened.

In addition to permitting a compact construction, the orientation and configuration of the scavenge passages 59 and 61 and the relationship of their ports 62, 64 and 65 is such that a swirling motion will be given to the intake charge as it enters the cylinder liners 43. The arcuate shape of the passages 59 and 61 contributes to this swirling motion and as a result the intake charge delivered to the cylinder liners 43 will flow in such a direction so as to improve scavenging efficiency and insure that all of the exhaust gases will be expelled while at the same time insuring against the loss of any fresh fuel air charge out of the exhaust system. The intake gasses generally travel along the wall of the cylinder liner 43 in a direction away from the exhaust ports 53 until the intake charge is redirected by the cylinder head 48 so as to flow downwardly and toward the exhaust port 53. Also, as has been noted, the angular position of the arcuate scavenge passages 59 and 61 cause a centrifugal force to be exerted on the intake charge which improves the scavenging action. The higher velocity of the gases will also be contiguous to the auxiliary scavenge ports 58 so as to further improve the operation.

Though the invention has been described in conjunction with a two-cylinder engine, as previously noted it may be employed with engines having other numbers of cylinders. Even though the arrangement permits compactness and at the same time achieves good scavenging, these benefits may also be enjoyed with a single cylinder engine. Various changes and modifications may be made without departing from the spirit and scope of the invention, as defined by the appended claims.

What is claimed is:

1. In a porting system for a two-cycle engine having a cylinder, exhaust port means opening through a wall of said cylinder and being intersected by a plane passing through the axis of said cylinder, and a plurality of scavenging passages having scavenging ports in said cylinder on opposite sides of said plane, the improvement comprising the centers of said scavenging ports lying in a plane perpendicular to the first mentioned plane and offset from said cylinder axis on the side opposite said exhaust port means, said scavenging passages having an arcuate shape in cross-sections taken perpendicular to the cylinder axis and defined by inner and outer surfaces spaced substantially equally from each other, the centers of said arcuate configuration being offset from the cylinder axis on the side opposite the exhaust port means so that the side of said scavenging passages closer to the exhaust port means lies closer to the cylinder.

2. In a porting system for a two-cycle engine having a cylinder, exhaust port means opening through a wall of said cylinder and being intersected by a plane passing through the axis of said cylinder, and a plurality of scavenging passages having scavenging ports in said cylinder on opposite sides of said plane, the improvement comprising the centers of said scavenging ports lying in a plane perpendicular to the first mentioned plane and offset from said cylinder axis on the side opposite said exhaust port means, said scavenging passages having inlets disposed in communication with the crankcase, said scavenging ports being positioned farther from the exhaust port means in a direction around the circumference of said cylinder than said inlets so that the scavenging passages extend at an angle to the cylinder axis.

3. A porting system as set forth in claim 2 wherein the scavenging passages have an arcuate shape in cross-sections taken perpendicular to the cylinder axis, the centers of said arcuate configuration being offset from the cylinder axis on the side opposite the exhaust port means so that the side of said scavenging passages closer to the exhaust port means lies closer to the cylinder.

4. A porting system as set forth in any one of claims 1, 2 or 3 wherein the scavenging passages are arranged in pairs and are symmetrically disposed relative to the first mentioned plane.

5. A porting system as set forth in any one of claims 1, 2 or 3 wherein the engine has a plurality of cylinders, ports and passages as defined, the first mentioned planes of all of the cylinders being disposed at an angle to a line connecting the cylinder axes which angle is not equal to 90 degrees.

6. A porting system for a two cycle engine having a cylinder, exhaust port means opening through a wall of said cylinder and being intersected by a plane passing through the axis of said cylinder and a plurality of scavenging passages having scavenging ports in said cylinder on opposite sides of said plane, the improvement comprising said scavenging passages having an arcuate configuration in cross-sections taken perpendicular to the cylinder axis and defined by inner and outer surfaces spaced substantially equally from each other, the center of said arcs being offset from the axis of the cylinder on the side away from the exhaust port means.

7. A porting system as set forth in claim 6 wherein the axis of the arc lies in the first mentioned plane.

8. A porting system as set forth in claim 7 wherein the scavenge passages have inlets disposed in communication with the crankcase, said scavenging ports being positioned farther from the exhaust port means in a direction around the circumference of said cylinder than said inlets so that the scavenging passages extend at an angle to the cylinder axis.

9. A porting system for a two cycle engine having a cylinder, exhaust port means opening through a wall of said cylinder and being intersected by a plane passing through the axis of said cylinder and a plurality of scavenging passages having scavenging ports in said cylinder on opposite sides of said plane, the improvement comprising said scavenging passages having inlets in the communication with the crankcase, the inlets being positioned closer to the exhaust port means than said scavenging ports in a direction around the circumference of said cylinder so that said scavenging passages extend at an angle to the cylinder axis, said plane being disposed at an angle relative to the axis of rotation of the associated crankshaft that is not equal to ninety degrees (90°).

10. A porting system as set forth in claim 1 wherein the plane is disposed at an angle to the axis of rotation of the associated crankshaft that is not equal to ninety degrees (90°).

11. A porting system as set forth in claim 2 wherein the plane is disposed at an angle to the axis of rotation of the associated crankshaft that is not equal to ninety degrees (90°).

12. A porting system as set forth in claim 6 wherein the plane is disposed at an angle to the axis of rotation of the associated crankshaft that is not equal to ninety degrees (90°).

13. A porting system as set forth in claim 8 wherein the plane is disposed at an angle to the axis of rotation of the associated crankshaft that is not equal to ninety degrees (90°).

* * * * *